US007117803B2

(12) United States Patent
Dye

(10) Patent No.: US 7,117,803 B2
(45) Date of Patent: Oct. 10, 2006

(54) APPARATUS FOR THE PYROLYSIS OF MATERIAL

(75) Inventor: Kenneth Dye, Torquay (GB)

(73) Assignee: Environmental Power International (Holdings) Ltd, (GB)

( * ) Notice: Subject to any disclaimer, the term of this patent is extended or adjusted under 35 U.S.C. 154(b) by 0 days.

(21) Appl. No.: 10/501,185

(22) PCT Filed: Jan. 13, 2003

(86) PCT No.: PCT/GB03/00103

§ 371 (c)(1),
(2), (4) Date: Jul. 13, 2004

(87) PCT Pub. No.: WO03/057801

PCT Pub. Date: Jul. 17, 2003

(65) Prior Publication Data

US 2005/0120925 A1 Jun. 9, 2005

(30) Foreign Application Priority Data

Jan. 14, 2002 (GB) ..... 0200717.7

(51) Int. Cl.
*F23K 3/00* (2006.01)

(52) U.S. Cl. ..... 110/229; 110/285; 110/267

(58) Field of Classification Search ..... 110/229, 110/230, 231, 285, 267, 286; 201/22; 208/113, 208/164; 48/210, 111; 432/72; 202/117, 202/118, 119

See application file for complete search history.

(56) References Cited

U.S. PATENT DOCUMENTS

| | | | | |
|---|---|---|---|---|
| 1,428,636 | A * | 9/1922 | Hurlbut | 110/270 |
| 1,431,882 | A * | 10/1922 | Erith | 110/291 |
| 1,523,682 | A | 1/1925 | Aron | |
| 2,097,747 | A | 11/1937 | Suzuki | |
| 2,615,834 | A | 10/1952 | Franklin et al. | |

FOREIGN PATENT DOCUMENTS

| | | |
|---|---|---|
| DE | 374918 | 5/1923 |
| GB | 2165811 | 4/1986 |

* cited by examiner

*Primary Examiner*—Kenneth Rinehart
(74) *Attorney, Agent, or Firm*—Iandiorio & Teska

(57) ABSTRACT

Apparatus (2) for the pyrolysis of material, which apparatus (2) comprises a pyrolysis chamber (4), an inlet (6) at a first end (8) of the pyrolysis chamber (4), an outlet (10) at a second end (12) of the pyrolisis chamber (4), and feed means (14) for feeding the material through the pyrolysis chamber (4), the feed means (14) comprising a cranked member (16), at least one elongate member (18) which extends along the pyrolysis chamber (4) between the inlet (6) and the outlet (10) and which has a first end (20) adjacet the (6) inlet and a second end (22) adjacent the outlet (10), a feed formation connected to the first end (20) of the elongate member (18), and connector means (24) which connects the send end (22) of the elongate member (18) to the cranked member (16), and the feed means (14) being such that rotation of the cranked member (16) causes the elongate member (18) to move backwards and forwards and the feed formation to move the material from the inlet (6) towards the outlet (10).

14 Claims, 2 Drawing Sheets

APPARATUS FOR THE PYROLYSIS OF MATERIAL

This invention relates to apparatus for the pyrolysis of material. The material may be any suitable type of material. Thus, for example, the material may be waste material. The waste material may be domestic, industrial or natural waste material, or combinations of such material.

Apparatus for the pyrolysis of material is well known. This known apparatus tends to be expensive to produce, construct, maintain and operate. One particular area in which the known apparatus is expensive as aforesaid is with regard to moving the material through a pyrolysis chamber in the apparatus. It is an aim of the present invention to reduce this problem.

Accordingly in the present invention provides apparatus for the pyrolysis of material, which apparatus comprises a pyrolysis chamber, an inlet at a first end of the pyrolysis chamber, an outlet at a second end of the pyrolysis chamber, and feed means for feeding the material through the pyrolysis chamber, the feed means comprising a cranked member in the pyrolysis chamber, at least one elongate member which extends along the pyrolysis chamber between the inlet and the outlet and which has a first end adjacent the inlet and a second end adjacent the outlet, a feed formation connected to the first end of the elongate member such that the feed formation cannot move with respect to the first end of the elongate member, and connector means which connects the second end of the elongate member to the cranked member, and the feed means being such that rotation of the cranked member causes the elongate member and the feed formation to move backwards and forwards with the feed formation moving horizontally in the material from the inlet towards the outlet in order to move the material towards the outlet, and the elongate member and the feed formation moving above the material from the outlet to the inlet.

The feed means utilised in the pyrolysis chamber is able to be inexpensively produced, constructed, maintained and operated. This thus helps to reduce these particular costs in the overall apparatus for the pyrolysis of the material, for example waste material.

The apparatus may include mounting means for hang mounting the first end of the elongate member in order to facilitate the movement backwards and forwards of the elongate member and the movement of the material by the feed formation.

The mounting means may be a hanging bar or a hanging spring. Other types of mounting means may be employed.

Preferably, the feed formation is a rake head. Other types of feed formation may however be employed. The feed formation may be a rake assembly which is suspended over the static bed. The rake assembly may comprise either single or multiple rakes. The rakes may be mounted as one unit and may operate independently of one another or operate in a synchronised order, as necessary and appropriate.

Each rake may be connected to a cranked member or any number of cranked members in order to set up a geometry of movement capable of moving the material to be processed through the chamber. The mechanism through which the rake assembly is suspended may be adjustable in such manner as to allow the height at which this unit is suspended over the bed to be adjustable. The direction in which the rake assembly flows is preferably adjustable in order to allow a reverse direction to be applied as necessary. The underside of the rake assembly may be fitted with any number of blades, pins, hooks, or various shaped protrusions, that protrude downwards towards the bed of the process chamber. The length, depth, spacing, angle and design of these protrusions may be constant throughout the entire length of the bed, or may be a mixture of different protrusions, spacings etc. according to need.

The design of the elements of the rake may be variable because, for example, some materials (predominantly those of a finer granularity or unit size) are more likely to require a series of plain blades to draw the material along the length of the chamber, whilst other materials may require either a series of pins, hooks or teeth.

The rake assembly may operate at pre-set and constant speed or be infinitely variable, in order to allow adjustment to be made to both process speed and residence time, according to the requirements of the material being processed at any one time.

Usually, the apparatus will be one in which there are at least two of the elongate members, and at least two of the feed formations, there being one of the feed formations for each one of the elongate members. More preferably, there are three of the elongate members, and three of the feed formations.

The apparatus may include drive means for driving the cranked member.

The drive means will usually include a motor. The drive means may include a chain and sprocket arrangement.

The pyrolysis chamber may be an outer chamber which is made of a metal and which has a heat insulating lining. The metal will usually be steel but other metals may be employed.

The apparatus may be one in which a floor part of the pyrolysis chamber is formed by a floor of the outer shell and the heat insulating lining on the floor of the outer shell. The heat insulating lining on the floor of the pyrolysis chamber is preferably formed of fire bricks. If desired, the pyrolysis chamber may have a floor in the form of a surface upon which the material sits and through which the heat is transmitted to pyrolize the material. The bed may be formed by creating a raised floor within a main chamber under which the heat source is placed. The bed floor may be formed of thick ceramic plate, but it could be formed of any substance capable of remaining stable under intense heat, whilst at the same time allowing the heat to permeate through to the other side in order to process the material.

Preferably, the pyrolysis chamber is constructed as a large long horizontally-extending chamber. Other shapes for the pyrolysis chamber may however be employed.

The material may be introduced to the apparatus in any suitable way. Thus, the material may be introduced into the apparatus by one or more of the following.

- Feed Auger: either single or multiple screw, having either standard fins/webs or incorporating webs/fins modified with hooks/claws or other such variations.
- Gravity Feed: whether dropped directly or via a series of hoppers/chambers or other such means. The hoppers may have air tight doors between them or not as required.
- Ram Drive: whether pushed into the main process chamber by means of a single or multiple ram device, howsoever powered.

An embodiment of the invention will now be described solely by way of example and with reference to the accompanying drawings in which.

Figure 1:
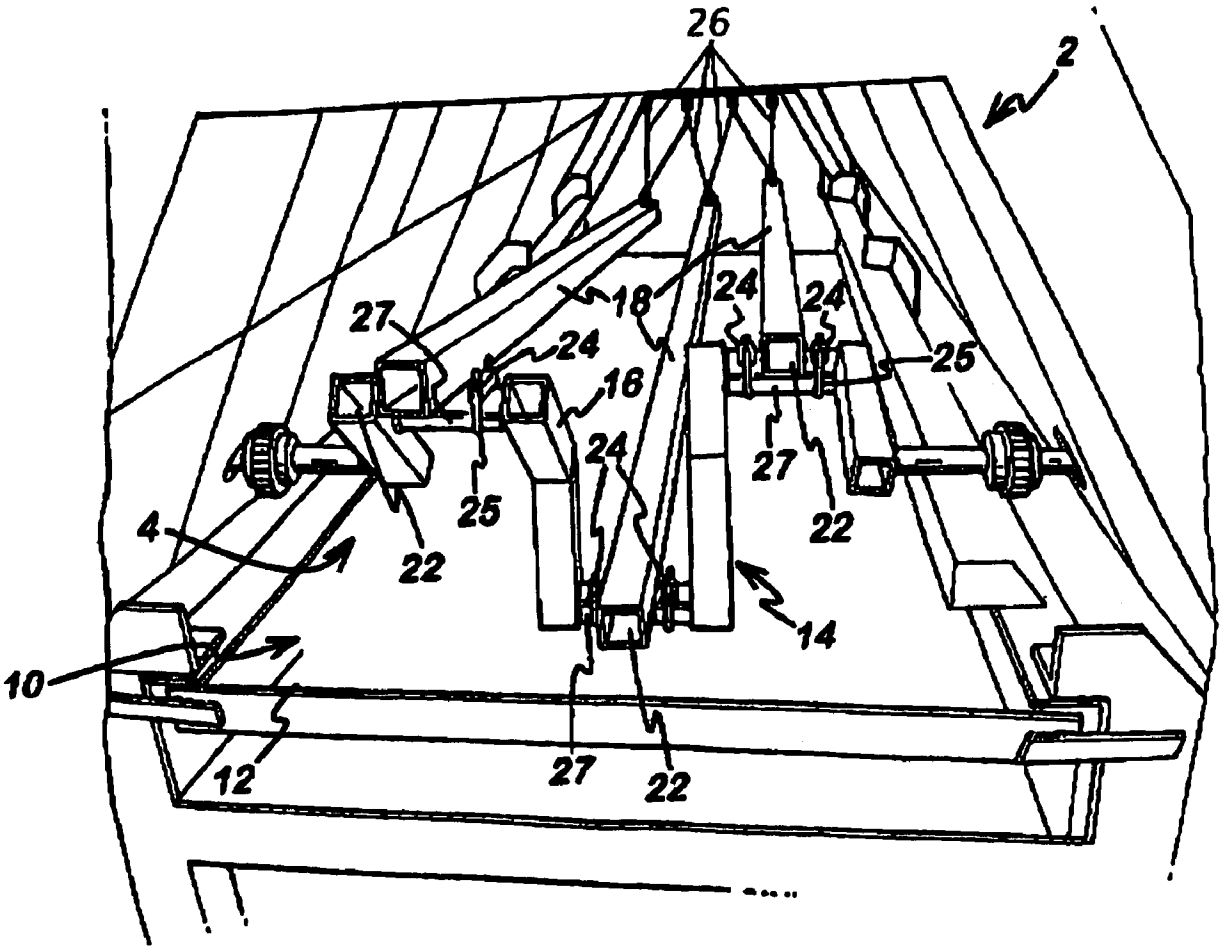
FIG. 1 shows apparatus for the pyrolysis of waste material, the apparatus having a pyrolysis chamber and feed means.

Referring to the drawings, there is shown apparatus 2 for the pyrolysis of waste material. The waste material may be domestic, industrial or natural waste material, or combinations of such material. The apparatus 2 comprises a pyrolysis chamber 4, an inlet 6 at a first end 8 of the pyrolysis chamber 4, and an outlet 10 at a second end 12 of the pyrolysis chamber 4. The apparatus 2 also comprises feed means 14 for feeding the waste material through the pyrolysis chamber 4.

The feed means 14 comprises a cranked member 16 and three elongate members 18 which extend along the pyrolysis chamber 4 between the inlet 6 and outlet 10. Each elongate member 18 has a first end 20 adjacent the inlet 6, and a second end 22 adjacent the outlet 10.

A feed formation (not shown) is connected to the first end 20 of each one of the elongate members 18 such that each feed formation cannot move with respect to the first end 20 of its elongate member 18. Connector means 24 connect the second end 22 of each one of the elongate members 18 to the cranked member 16. The connector means 24 are each U-bolts 25 and a bearing sleeve 27. The feed means 14 is such that rotation of the cranked member 16 causes the elongate members 18 and their feed formations to move backwards and forwards with the elongate members 18 and the feed formations moving horizontally in the waste material from the inlet 6 to the outlet 10 in order to move the waste material towards the outlet 10, and the elongate members 18 and the feed formations moving above the material from the outlet 10 to the inlet 6.

Figure 2:
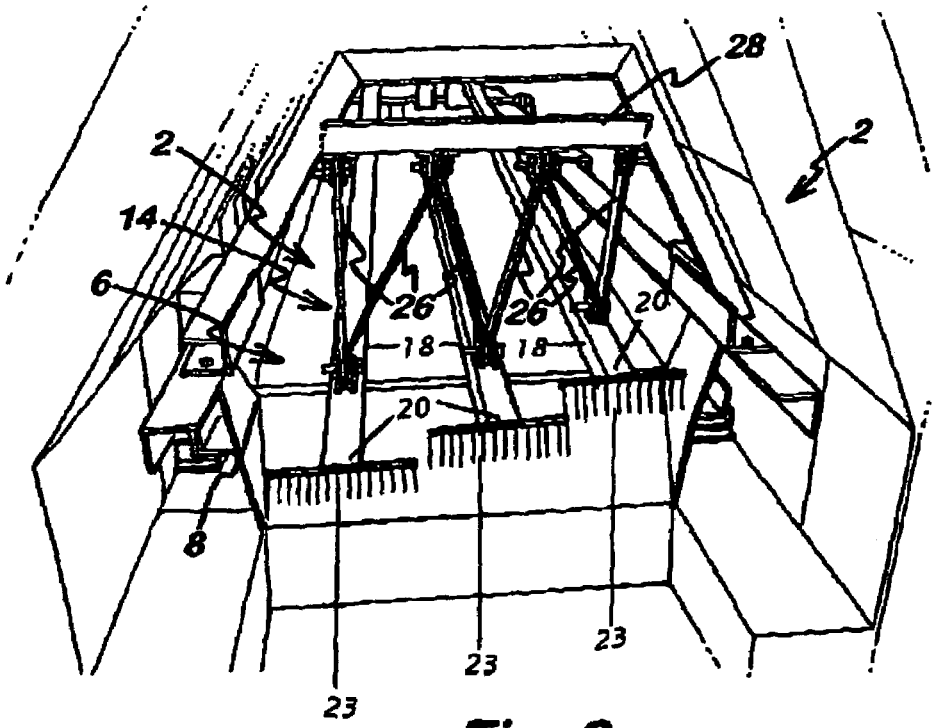
FIG. 2 is a view similar to FIG. 1 but shows the inside of the pyrolysis chamber and the feed means from an end of the pyrolysis chamber opposite to that shown in FIG. 1.

As shown in FIG. 2, the apparatus 2 includes mounting means 26 for hang mounting the first end 20 of each one of the elongate members 18 in order to facilitate the movement backwards and forwards of the elongate members 18, and thus the movement of the waste material by the feed formation from the inlet 6 to the outlet 10. As shown in FIG. 2, the mounting means 26 is in the form of a plurality of hanging bars which hang from a transverse frame member 28.

Figure 3:
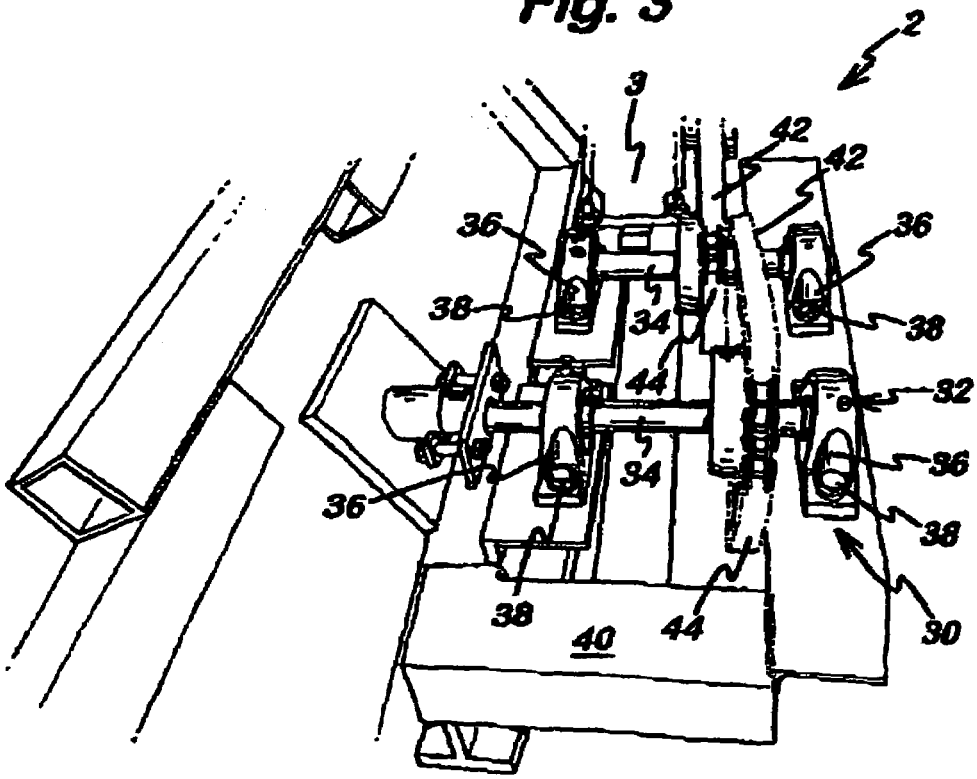
FIG. 3 shows part of drive means for driving a cranked member forming part of the feed means shown in FIGS. 1 and 2.

The apparatus 2 includes drive means 30 for driving the cranked member 16. The drive means 30 includes a motor 31 as shown in FIG. 3. The drive means 30 also includes a chain and sprocket arrangement 32. The chain and sprocket arrangement 32 comprises two shafts 34. Each shaft 34 is mounted in bearing support members 36 which are secured by bolts 38 to a frame part 40. The chain and sprocket arrangement 32 also comprises two chains 42 which pass over sprockets 44 mounted on the shafts 34 as shown.

The pyrolysis chamber 4 is a steel outer shell which has a heat insulating lining. A floor part of the pyrolysis chamber 4 is formed by the outer shell and the heat insulating lining on the floor of the outer shell. The heat insulating line on the floor of the pyrolysis chamber may be formed of fire bricks or any other suitable and appropriate material. The pyrolysis chamber 4 is constructed as a large long horizontally-extending chamber.

As can be appreciated from the drawings, the feed means 14 is simple to produce, construct, maintain and operate. This helps to keep the overall cost of the apparatus 2 down. This in turn helps to make the apparatus 2 commercially viable as compared to many known types of pyrolysis apparatus which are just not commercially viable in terms of production, construction, maintenance and operation costs.

It is to be appreciated that the embodiment of the invention described above with reference to the accompanying drawings has been given by way of example only and that modifications may be effected. Thus, for example, the material may be other than waste material. The material may be material which has been pre-treated and sorted to create a consistent feed stock. The feed formation is preferably in the form of a rake head. The rake head can be formed by mounting a tube transversely across the first ends 20 of the elongate members 18. This transverse tube then has rods welded underneath it and extending downwardly in order to form the rake head. Other designs may however be employed. Also, although the drawings show the mounting means 26 in the form of hanging bars, they may alternatively be hanging springs or other devices as may be required.

The invention claimed is:

1. Apparatus for the pyrolysis of material, which apparatus comprises a pyrolysis chamber, an inlet at a first end of the pyrolysis chamber, an outlet at a second end of the pyrolysis chamber, and feed means for feeding the material through the pyrolysis chamber, the feed means comprising a cranked member in the pyrolysis chamber, at least one elongate member which extends along the pyrolysis chamber between the inlet and the outlet and which has a first end adjacent the inlet and a second end adjacent the outlet, a feed formation connected to the first end of the elongate member such that the feed formation cannot move with respect to the first end of the elongate member, and connector means which connects the second end of the elongate member to the cranked member, and the feed means being such that rotation of the cranked member causes the elongate member and the feed formation to move backwards and forwards with the feed formation moving horizontally in the material from the inlet towards the outlet in order to move the material towards the outlet, and the elongate member and the feed formation moving above the material from the outlet to the inlet.

2. Apparatus according to claim 1 and including mounting means for hang mounting the first end of the elongate member in order to facilitate the movement backwards and forwards of the elongate member and the movement of the material by the feed formation.

3. Apparatus according to claim 2 in which the mounting means is a hanging bar or a hanging spring.

4. Apparatus according to claim 1 in which the feed formation is a rake head.

5. Apparatus according to claim 1 in which there are at least two of the elongate members, and at least two of the feed formations, there being one of the feed formations for each one of the elongate members.

6. Apparatus according to claim 5 in which there are three of the elongate members, and three of the feed formations.

7. Apparatus according to claim 1 and including drive means for driving the cranked member.

8. Apparatus according to claim 7 in which the drive means includes a motor.

9. Apparatus according to claim 8 in which the drive means includes a chain and sprocket arrangement.

10. Apparatus according to claim 1 in which the pyrolysis chamber is an outer shell which is made of a metal and which has a heat insulating lining.

11. Apparatus according to claim 10 in which the metal is steel.

12. Apparatus according to claim 10 in which a floor part of the pyrolysis chamber is formed by a floor of the outer shell and the heat insulating lining on the floor of the outer shell.

13. Apparatus according to claim 12 in which the heat insulating lining on the floor of the pyrolysis chamber is formed of fire bricks.

14. Apparatus according to claim 1 in which the pyrolysis chamber is constructed as a large long horizontally-extending chamber.

* * * * *